US005145359A

United States Patent [19]

Ancona et al.

[11] Patent Number: 5,145,359

[45] Date of Patent: Sep. 8, 1992

[54] BURNER FOR THERMIC GENERATORS

[75] Inventors: Giuseppe Ancona, Sesto San Giovanni; Giancarlo Benelli, Empoli; Gennaro De Michele, Pisa; Sergio Ligasacchi, San Giuliano Terme; Gianni Mascalzi, Como; Giancarlo Scavizzi, Milan; Giuliano Trebbi, Pisa; Aldo Zennaro, Milan, all of Italy

[73] Assignees: Ente Nazionale Per l'Energia Elettrica, Rome; Ansaldo Componenti s.r.l., Genova, both of Italy

[21] Appl. No.: 688,409

[22] Filed: Apr. 22, 1991

[30] Foreign Application Priority Data

Apr. 20, 1990 [IT] Italy ..... 9370 A/90

[51] Int. Cl.[5] ..... F23M 9/00

[52] U.S. Cl. ..... 431/184; 239/402.5; 239/405; 431/278

[58] Field of Search ..... 431/181, 182, 183, 184, 431/187, 278, 186, 284; 239/402.5, 403–406

[56] References Cited

U.S. PATENT DOCUMENTS

| | | | |
|---|---|---|---|
| 2,380,463 | 7/1945 | Poole | 431/184 |
| 3,391,981 | 7/1968 | Voorheis et al. | 431/184 |
| 3,904,349 | 9/1975 | Peterson et al. | 431/184 |
| 4,018,554 | 4/1977 | Teodorescu et al. | 431/183 |
| 4,842,509 | 6/1989 | Hasenack | 431/183 |
| 4,927,352 | 5/1990 | Chung | 431/184 |

FOREIGN PATENT DOCUMENTS

| | | |
|---|---|---|
| 0280568 | 2/1988 | European Pat. Off. . |
| 0452608 | 12/1990 | European Pat. Off. . |
| 8905308 | 7/1989 | Fed. Rep. of Germany . |
| 2394753 | 1/1979 | France . |

*Primary Examiner*—James C. Yeung

*Attorney, Agent, or Firm*—Browdy and Neimark

[57] ABSTRACT

An improved burner (4) for fuel oil and fuel gas with low NOx production, wherein the combustion air is subdivided in three streams and with flow rate control swirlers in each air streams. The stream of primary air is intercepted by a swirler comprising an array of radially fixed tabs (15) mounted in correspondence to the outlet section in the combustion chamber (3), while the secondary and tertiary air swirlers comprise tabs (18, 19) turnable around axes disposed perpendicular and parallel to the central axis of the burner, respectively. The primary and secondary air inlets have a variable, continuously adjustable section. Furthermore, there are provided mass rate meters (24, 25) near the outlet section of the secondary and tertiary air streams in the combustion chamber (3) substantially unaffected by the vorticity induced by said swirlers.

10 Claims, 1 Drawing Sheet

BURNER FOR THERMIC GENERATORS

DESCRIPTION

1. Field of the Invention

The present invention relates to an improved burner for fuel oil and fuel gas with low NOx production.

2. Description of the prior art

In the known burners of the above mentioned type it is known the technique to subdivide the total combustion air in more streams, expecially a primary, a secondary and a tertiary stream, in order to achieve an improved combustion control both from the thermic and stoichiometric point of view.

The function of primary air is essentially to ensure the cleaning and the cooling of the central zone of the burner, whereas the function of a correct ratio between the secondary and tertiary air momentum is to provide the flame stoichiometric concentration suitable for the redox reactions to occur.

The burners for thermic generators, expecially for thermoelectric generators, operating in this way, include a lance with relevant atomizer, when liquid fuel is used, or several lances when gaseous fuel is used, or a combination of them if the burner is designed to use both type of fuel. According to the above mentioned technique, in a coaxial relation to said fuel feeding means there are provided ducts for primary, secondary and tertiary air flowing to the combustion chamber together with the fuel and communicating with an air chamber. In one or more of these air ducts there are provided swirlers for the registration of the air vorticity for the aerodinamic control of combustion. In these burners the swirlers control both the air flowrate and the distribution of different air jets injected in the combustion chamber. The control of air distribution among the primary, secondary and tertiary air streams, also involves some modifications in the vorticity characteristics of the relevant turbulent jets. This results in a inadequate possibility of controlling the combustion process and expecially the NOx emission in different operating conditions of the burner, in relation both to the thermic load and the chemical-physic characteristics of the different fuels used.

The object of the present invention is to provide an improved burner with low NOx emission, useful for fuel oil and fuel gas, fit to be installed in combustion units of both new steam generators or furnaces, and of existing plants.

Another object of the present invention is to provide a burner, of the above mentioned type, capable of performing a multistage combustion with a suitable fluids dynamics of the combustion air subdivided in several streams each controlled as far as both flowrate and air distribution are concerned.

A further object of the present invention is to provide a burner of the above mentioned type that allows a reduction of the maximum flame temperature while limiting the spatial intensity of heat release in order to reduce the rate of production of thermic NOx.

Another object of the present invention is to provide a burner of the above mentioned type capable of ensuring a sufficient amount of combustion air for postcombustion in such a way to limit also the percentage of solid and gaseous unburnts in the smokes.

SUMMARY OF THE INVENTION

These objects are achieved with the improved burner according to the present invention, wherein the combustion air is subdivided in a primary, secondary and tertiary stream and is fed to a combustion chamber coaxially to the fuel feeding, the vorticity of each of said air streams being controlled and registered by a swirler. The swirler for the primary air comprises an array of radially fixed tabs close to the outlet section of the primary stream in the combustion chamber, while the secondary and the tertiary air swirlers comprise tabs turnable around axes disposed perpendicular and parallel to the central axis of the burner, respectively. The primary and secondary air inlets have a variable, continuously adjustable section and furthermore there are provided mass rate meters near the outlet sections of the secondary and tertiary streams to the combustion chamber substantially unaffected by the vorticity induced by said swirlers.

In a particularly preferred embodiment of the invention the streams of primary, secondary and tertiary air are collected to the combustion chamber, in a coaxial relation to said fuel feeding means and there are provided among them separating means for deviating the streams of secondary and tertiary air in divergent directions.

BRIEF DESCRIPTION OF THE DRAWINGS

Further characteristics and advantages of the improved burner according to the present invention will become apparent from the following description of a not limiting and exemplifying embodiment thereof, with reference to the accompanying drawings, in which.

DESCRIPTION OF THE PREFERRED EMBODIMENT

Figure 1:
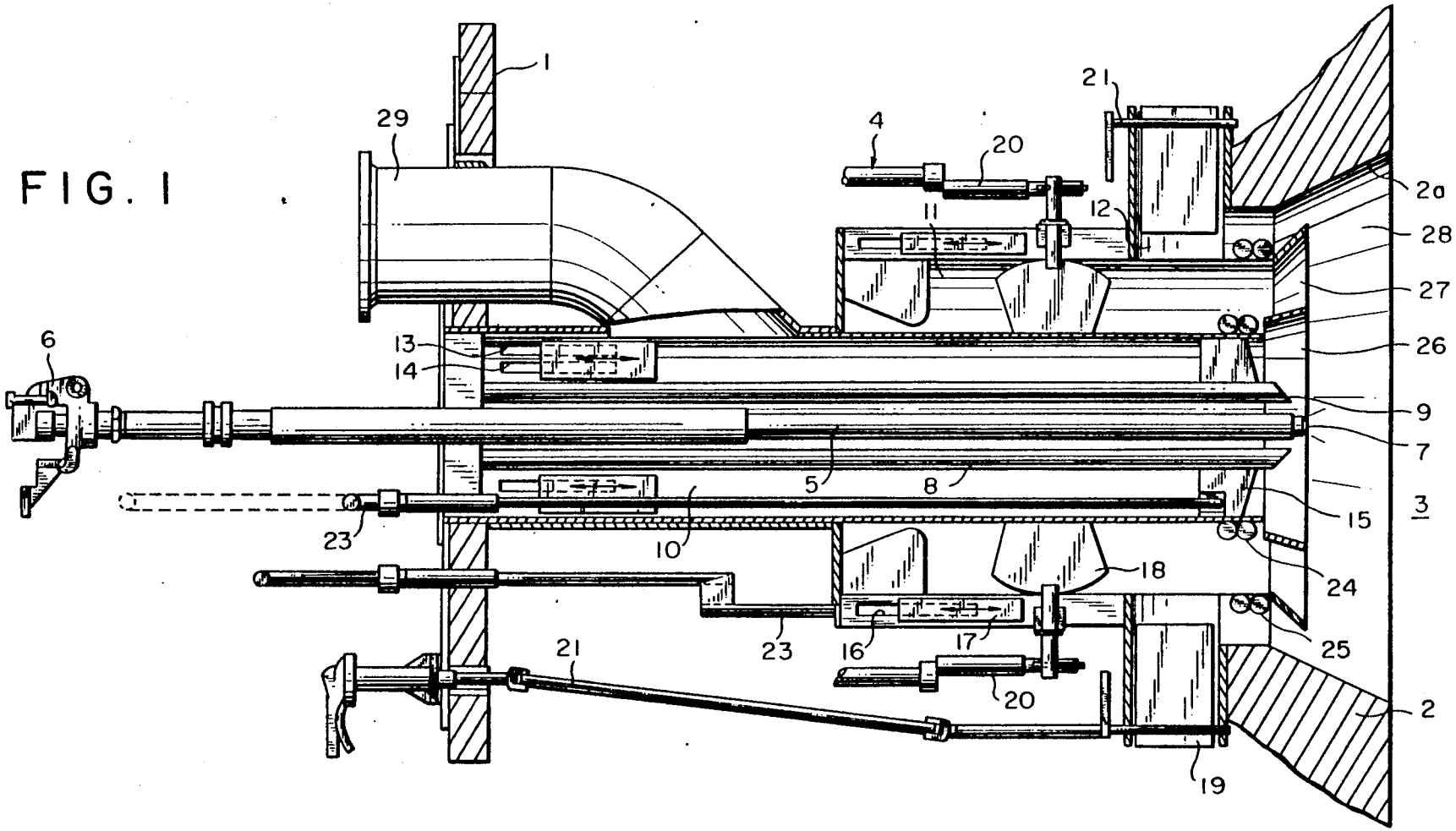
FIG. 1 is a schematic overall view in longitudinal section of the burner assembly according to the present invention.

With reference to FIG. 1, the burner assembly according to the invention comprises an external wall 1 delimiting a combustion chamber 3 of a stream generator or of a furnace of known type or the like. A burner 4 according to the present invention is fixed to the wall 1 and to the inlet section 2. The burner 4 comprises a lance 5 for liquid fuel connected to a fuel injection header 6 external to the wall 1 and ending in the combustion chamber 3 with an atomizer 7, of known type and not described in detail, for nebulizing the fuel. A row of lances 8 for gaseous fuel with nozzles 9 inclined in relation to the central axis of the burner is arranged coaxialy to the lance 5, said lances extending from a toroidal header not shown, external to wall 1.

The combustion air is divided in three air streams, i.e. primary, secondary tertiary air and a primary duct 10, a secondary duct 11 and a tertiary duct 12 are respectively provided for feeding these streams to the combustion chamber 2. The primary air duct 10 extends coaxially to the lances 5 and 8, which are housed therein, and near the wall 1 is equipped with air feeding inlets 13 interceptable by movable air locks 14, while in proximity of its outlet section in the combustion chamber 3 tabs 15 radially fixed on a drum not shown are provided to ensure an adequate vorticity of the primary stream. The secondary air duct 11 is fixed externally and coaxially to the duct of primary 10 and it also comprises air feeding inlets 16 interceptable by moveable air locks 17. Furthermore, in order to give vorticity to the secondary air, inside the duct 11 there is provided an array of tabs 18 pivotally mounted on radial axes and therefore inclinable in relation to the flow direction. The tertiary air duct 12 has a radial inlet in which a plurality of tabs 19 pivotally mounted on a row of axes parallel to the longitudinal axis is arranged and, therefore, also the inclination of tabs 19 is adjustable with respect to the flow direction. For the control of the two swirlers (tabs 18 and 19) housed in the ducts of secondary and tertiary air, articulated control arms 20 and 21, respectively, are provided in a known way, connected to the tabs 18 and 19 and extended externally to the wall 1 for manual or motored operation. Likewise, for the air locks 14 and 17 installed on the inlets 13 and 16 of the primary and secondary air ducts, there are provided control arms 22 operable from the outside. The drum bearing the tabs 15 installed in the duct 10 of primary air can be axially slid by a rod 23 extending externally to the wall 1 for its operation.

Near the outlet section to the combustion chamber 3 flowmeters 24 and 25 of the annular pitot type are provided in the ducts 11 and 12 of the secondary and tertiary air, each substantially comprising a couple of annular pipes coaxial to the longitudinal axis, which allow to detect a significant differential pressure in the operating range of the burner with a good measure sensitivity. These flowmeters are widely insensitive to the orientation of tabs 18 and 19 of the swirlers placed upstream, and therefore unaffected by the vorticity induced by them in the secondary and tertiary streams.

A flow divider 26 formed by a diverging frusto conic surface is provided between the duct of primary air 10 and secondary air 11, in correspondence with their outlet section to the combustion chamber. A similar flow divider 27 is provided in the same position between the duct of the secondary air 11 and that of tertiary air 12. In particular, the flow divider 27 and the truncated cone surface 2*a* of wall 2 delimits a throat 28 through which the stream of tertiary air is accelerated and further deviated with respect to the stream of secondary air, in such a way as to deviate it towards the part of the combustion chamber considered more suitable for the completion of the combustion itself.

Advantageously, in order to obtain a further reduction of NOx production and also to limit the flame temperature in the combustion chamber the injection of recycled smokes or gasses can be provided through a circuit fed by an independent fan, through an additional duct 29 confluent in the duct 10 of primary air, as shown in FIG. 1, or directly fed to the combustion chamber 3 by a coaxial independent duct, not shown.

The burner according to the invention provides for the control of the combustion air flowrate by keeping constant the attitude of the tabs 18 and 19 of the swirlers placed in the stream of secondary and tertiary air, therefore without appreciable interferences on the vorticity range. This provides for the optimization of flame characteristics under the thermochemical point of view. In particular, the control of air distribution flowrate among the ducts associated to the vorticity control, allows the control of the mixing for the optimization of the characteristics of the combustion air jet.

The combination of the above mentioned control capability with the availability of a reliable flowrate measure in the secondary and tertiary ducts, is of help when balancing operation have to be carried out in the industrial, typically multiburner systems such as those provided for the steam generators.

Furthermore, it has to be pointed out that the radial arrangement of the tertiary swirler with respect to the substantially axial arrangement of the swirler installed in the duct of secondary air, allows a more effective vorticity production and a pressure distribution of the tertiary air, behind the divider 27, which helps the penetration of the tertiary air into the combustion chamber.

Variations and/or modifications may be brought to the improved burner according to the present invention without departing from the scope of the invention itself.

We claim:

1. Improved burner for fuel oil and fuel gas with low $NO_x$ production comprising primary, secondary and tertiary air ducts coaxially arranged about a longitudinal axis for feeding combustion air to a combustion chamber and having respective outlet sections connected to said combustion chamber, fuel duct means coaxial to said air ducts, swirler means for controlling the vorticity of the combustion air arranged in said primary, secondary and tertiary ducts, the primary duct swirler comprising an array of radially sixed tabs in correspondence with said outlet section, the secondary and tertiary duct swirlers further comprising tabs turnable around axes disposed perpendicular to and, respectively, parallel to said longitudinal axis, said primary and secondary air ducts comprising air inlet means with continuously variable and adjustable cross sections, mass rate meters being further provided near the outlet sections of said secondary and tertiary ducts substantially unaffected by the vorticity induced by said swirler means.

2. Improved burner according to claim 1, wherein flow separating means are provided between primary, secondary and tertiary air ducts, downstream of their outlet section to said combustion chamber, for deviating combustion air in divergent directions.

3. Improved burner according to claim 2, wherein said flow separating means comprise essentially a couple of coaxial baffles with a truncated cone shape and with different inclination arranged between said primary and secondary air ducts and, respectively, between said secondary and tertiary air ducts, said baffles fixedly extending from each outlet section of said primary and secondary air ducts.

4. Improved burner according to claim 3, wherein a throat is delimited between said separating baffle installed between the stream of secondary and tertiary air duct and a truncated cone divergent wall of the inlet section of said combustion chamber.

5. Improved burner according to claim 1, wherein a pair of mass rate meters in the air streams of secondary and tertiary air ducts each comprises a couple of annular pipes coaxial of the longitudinal axis.

6. Improved burner according to claim 1, wherein the combustion air is fed to respective primary and secondary air ducts through inlets interceptable by movable air locks.

7. Improved burner according to claim 1, wherein said primary swirler is axially sliding.

8. Improved burner according to claim 1, further comprising an additional duct for the injection of recycled smokes.

9. Improved burner according to claim 8, wherein said additional duct of recycled smokes flows into said primary air duct .

10. Improved burner according to claim 8, wherein said additional of recycled smokes is coaxial to said duct primary air duct and flows directly into said combustion chamber.

* * * * *